US012262744B2

(12) United States Patent
Qiu

(10) Patent No.: US 12,262,744 B2
(45) Date of Patent: Apr. 1, 2025

(54) ATOMIZING ASSEMBLY, ATOMIZER AND AEROSOL GENERATING DEVICE

(71) Applicant: CHANGZHOU PATENT ELECTRONIC TECHNOLOGY CO., LTD, Changzhou (CN)

(72) Inventor: Weihua Qiu, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 554 days.

(21) Appl. No.: 17/577,397

(22) Filed: Jan. 18, 2022

(65) Prior Publication Data

US 2022/0132926 A1 May 5, 2022

Related U.S. Application Data

(63) Continuation-in-part of application No. PCT/CN2020/101110, filed on Jul. 9, 2020.

(30) Foreign Application Priority Data

Jul. 19, 2019 (CN) ..... 201921150267.3

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/46* (2020.01); *A24F 40/485* (2020.01)

(58) Field of Classification Search
None
See application file for complete search history.

(56) References Cited

U.S. PATENT DOCUMENTS

2017/0127723 A1* 5/2017 Wu ..... A24F 40/44
2017/0215481 A1 8/2017 Li
(Continued)

FOREIGN PATENT DOCUMENTS

CN 104970444 A 10/2015
CN 105559150 A 5/2016
(Continued)

OTHER PUBLICATIONS

EPO Machine Translation: CN 104970444B (published Mar. 13, 2018), 2024. (Year: 2024).*
(Continued)

*Primary Examiner* — Manley L Cummins, IV
(74) *Attorney, Agent, or Firm* — Andrew C. Cheng

(57) ABSTRACT

An atomizing assembly for an atomizer is provided. The atomizer includes a liquid storage member and the atomizing assembly, the liquid storage member is used to store an aerosol-forming substrate. The atomizing assembly includes a heating assembly and a sealing member. The sealing member is provided with a receiving groove, the heating assembly includes a liquid absorbing member and a heating member, the liquid absorbing member is installed in the receiving groove. The liquid absorbing member includes a liquid absorbing surface used for contacting the aerosol-forming substrate and an atomizing surface on which the heating member is arranged, a protrusion is provided on the liquid absorbing surface, a space defined by the receiving groove, the liquid absorbing surface and the protrusion constitutes a liquid inlet groove. The aerosol-forming substrate is conducted by the liquid absorbing member from the liquid absorbing surface to the atomizing surface.

18 Claims, 8 Drawing Sheets

(51) Int. Cl.
*A24F 40/46* (2020.01)
*A24F 40/485* (2020.01)

(56) References Cited

U.S. PATENT DOCUMENTS

| | | | | |
|---|---|---|---|---|
| 2019/0246692 | A1* | 8/2019 | Li | A24F 47/00 |
| 2019/0350256 | A1* | 11/2019 | Hejazi | A24F 40/44 |
| 2021/0235756 | A1* | 8/2021 | Qiu | A24F 40/40 |
| 2021/0345670 | A1* | 11/2021 | Wang | A24F 40/10 |

FOREIGN PATENT DOCUMENTS

| | | | | | |
|---|---|---|---|---|---|
| CN | 104970444 | B | * | 3/2018 | |
| CN | 108185536 | A | * | 6/2018 | A24F 1/00 |
| CN | 109288136 | A | | 2/2019 | |
| CN | 105722412 | B | | 4/2019 | |
| CN | 210275886 | U | | 4/2020 | |
| EP | 3888479 | A1 | | 10/2021 | |
| WO | 2019032140 | A1 | | 2/2019 | |

OTHER PUBLICATIONS

International Search Report of PCT Patent Application No. PCT/CN2020/101110 issued on Oct. 10, 2020.
The extended European search report of EP application No. 20845097.3 issued on Aug. 11, 2023.

* cited by examiner

ATOMIZING ASSEMBLY, ATOMIZER AND AEROSOL GENERATING DEVICE

CROSS-REFERENCE TO RELATED APPLICATIONS

This application is a continuation-in-part of International Patent Application No. PCT/CN2020/101110, filed on Jul. 9, 2020, entitled "atomizing assembly, atomizer and aerosol generating device", which claims priority to Chinese Patent Application No. 201921150267.3, filed on Jul. 19, 2019. All of the aforementioned patent applications are hereby incorporated by reference in their entireties.

TECHNICAL FIELD

The present disclosure relates to an aerosol generating device, and more particularly, relates to an atomizing assembly, an atomizer and an aerosol generating device.

BACKGROUND

At present, the aerosol generating device on the market usually uses a liquid guiding rope made of fiber cotton to wind the heating component of the heating wire, and the liquid guiding efficiency is low. And when the output power of the aerosol generating device is too high, the liquid guiding rope will burn due to lack of liquid, and then produce peculiar smell, which will affect the user's smoking taste.

SUMMARY

Based on the above, it is necessary to provide an atomizing assembly with high liquid guiding efficiency.

It is also necessary to provide an atomizer with the atomizing assembly.

It is further necessary to provide an aerosol generating device with the atomizer.

The technical solutions adopted by the present disclosure to solve its technical problems are: an atomizing assembly for an atomizer, wherein the atomizer includes a liquid storage member and the atomizing assembly, the liquid storage member is configured to store an aerosol-forming substrate, the atomizing assembly includes a heating assembly and a sealing member, the sealing member is provided with a receiving groove, the heating assembly includes a liquid absorbing member and a heating member, the liquid absorbing member is installed in the receiving groove, the liquid absorbing member includes a liquid absorbing surface and an atomizing surface, the liquid absorbing surface is configured to contact the aerosol-forming substrate, a protrusion is provided on the liquid absorbing surface, a space defined by the receiving groove, the liquid absorbing surface and the protrusion constitutes a liquid inlet groove, the heating member is arranged on the atomizing surface, such that the aerosol-forming substrate is conducted by the liquid absorbing member from the liquid absorbing surface to the atomizing surface and atomized into smoke by the heating member arranged on the atomizing surface.

Further, the liquid absorbing member further includes a connecting surface, the connecting surface is connected between the liquid absorbing surface and the atomizing surface, the liquid absorbing surface and the atomizing surface are arranged opposite to each other, a direction from the atomizing surface toward the liquid absorbing surface is defined as the first direction of the liquid absorbing member, the protrusion is protrudingly provided on the liquid absorbing surface along the first direction.

Further, a dimension of the liquid absorbing member between the atomizing surface and the liquid absorbing surface along the first direction is the height h of the liquid absorbing member, a dimension of the protrusion along the first direction is the height H of the protrusion, and $0.25 \leq H/h \leq 0.75$.

Further, an area of any cross section of the liquid absorbing member along a direction perpendicular to the first direction is s, an area of any cross section of the protrusion along a direction perpendicular to the first direction is S, and $0.2 \leq S/s \leq 0.5$.

Further, a dimension of the protrusion along the first direction is the height H of the protrusion, an area of any cross section of the protrusion along a direction perpendicular to the first direction is S, and $S/H \geq 10$.

Further, a dimension of the liquid absorbing member between the atomizing surface and the liquid absorbing surface along the first direction is the height h of the liquid absorbing member, and 1.5 mm≤h≤5 mm.

Further, an air guiding passage is provided in the liquid absorbing member, one end of the air guiding passage passes through the atomizing surface, the other end of the air guiding passage passes through an outer surface of the protrusion.

Further, the liquid absorbing member is made of a porous material, and the protrusion is made of a porous material.

Further, the liquid absorbing surface and the atomizing surface are both flat and parallel to each other, the protrusion is located at the center of the liquid absorbing surface.

Further, the protrusion and the liquid absorbing member are integrally formed, the liquid absorbing member and the protrusion are made of a porous material.

Further, the heating member is attached on the atomizing surface or embedded in the atomizing surface.

Further, a groove side wall of the receiving groove is protrudingly provided with a resisting protrusion, an outer edge of the liquid absorbing surface abuts against the resisting protrusion, an electrode connecting end of the heating member corresponds to the resisting protrusion, the atomizing assembly further includes a base assembly, the base assembly includes a conductive member, the conductive member abuts against the electrode connecting end.

Further, a shape of any cross section of the liquid absorbing member along a direction perpendicular to the first direction is an ellipse, two electrode connecting ends of the heating member are located at two ends of a long axis of the ellipse.

Further, the base assembly further includes an atomizing bracket and an atomizing seat, the atomizing bracket is connected to the atomizing seat, the heating assembly and the sealing member are sandwiched between the atomizing bracket and the atomizing seat, the conductive member is installed on the atomizing seat.

Further, the atomizing bracket is provided with a mounting groove, the sealing member is installed in the mounting groove, the atomizing bracket is further provided with a liquid inlet hole, the liquid inlet hole is in communication with the liquid inlet groove through an open end of the sealing member close to the liquid absorbing surface.

Further, a sealing plate is provided on the open end of the sealing member close to the liquid absorbing surface, an upper end surface of the protrusion abuts against a lower end surface of the sealing plate, the sealing plate is provided with a communication hole, the communication hole is in communication with the liquid inlet groove and the liquid inlet hole.

Further, the atomizing bracket is further provided with an air outlet hole, the sealing plate is further provided with an air discharge hole, the air discharge hole is in communication with the air guiding passage and the air outlet hole.

An atomizer includes the atomizing assembly of any one of the foregoing, the atomizer further includes the liquid storage member, the liquid storage member is configured to provide the aerosol-forming substrate to the atomizer.

An aerosol generating device includes the aforementioned atomizer, the aerosol generating device further includes a power supply device, and the power supply device is electrically connected to the atomizer.

FIG. 7 is a bottom view of the connecting structure of the liquid absorbing member and the protrusion shown in FIG. 5;

FIG. 8 is a schematic diagram of the atomizing seat of the atomizing assembly shown in FIG. 4;

FIG. 9 is a cross-sectional view of the aerosol generating device shown in FIG. 1;

FIG. 10 is a cross-sectional view of the aerosol generating device shown in FIG. 9 along the A-A line;

FIG. 11 is another cross-sectional view of the aerosol generating device shown in FIG. 1 (rotated by 90° with respect to FIG. 9);

FIG. 12 is a cross-sectional view of the connection structure between the liquid absorbing member and the protrusion shown in FIG. 5.

| | | |
|---|---|---|
| atomizer 100 | power supply device 200 | battery housing 202 |
| liquid storage member 10 | liquid storage chamber 101 | second latching groove 11 |
| vent tube 12 | smoke outlet opening 13 | smoke outlet passage 120 |
| atomizing assembly 110 | base assembly 20 | atomizing bracket 21 |
| atomizing chamber 201 | mounting groove 211 | liquid inlet hole 212 |
| air outlet hole 216 | first latching tab 213 | atomizing seat 22 |
| air inlet passage 221 | air inlet groove 2211 | air guiding groove 2212 |
| air inlet hole 2213 | connecting plate 222 | mounting cavity 223 |
| first latching groove 224 | second latching tab 225 | mating groove 226 |
| through hole 227 | sealing ring 23 | conductive member 25 |
| conductive plate 251 | conductive column 252 | sealing sleeve 26 |
| liquid inlet opening 261 | air outlet opening 262 | heating assembly 30 |
| liquid absorbing member 31 | liquid absorbing surface 31a | atomizing surface 31b |
| protrusion 311 | connecting surface 31c | air guiding passage 312 |
| heating member 32 | electrode connecting end 321 | sealing member 40 |
| receiving groove 401 | communication hole 403 | liquid inlet groove 402 |
| air discharge hole 404 | resisting protrusion 405 | connecting portion 313 |
| free portion 314 | sealing plate 41 | |

The beneficial effects of the present disclosure are: in the atomizing assembly or atomizer or aerosol generating device of the present disclosure, the arrangement of the protrusion improves the structural strength of the liquid absorbing member. Meanwhile, since the structural strength of the liquid absorbing member is improved due to the protrusion, there is no need to increase the physical thickness of the liquid absorbing member, thereby ensuring the conduction efficiency of the liquid absorbing member to the aerosol-forming substrate is ensured, and achieving the effects of enhancing the structural strength of the liquid absorbing member and improving the conduction efficiency of the liquid absorbing member at the same time.

BRIEF DESCRIPTION OF THE DRAWINGS

The following describes the present disclosure further with reference to the drawings and embodiments.

DETAILED DESCRIPTION OF PREFERRED EMBODIMENTS

The present disclosure will now be described in detail with reference to the drawings. This figure is a simplified schematic diagram, which only illustrates the basic structure of the present disclosure in a schematic manner, so it only shows the structure related to the present disclosure.

Figure 1:
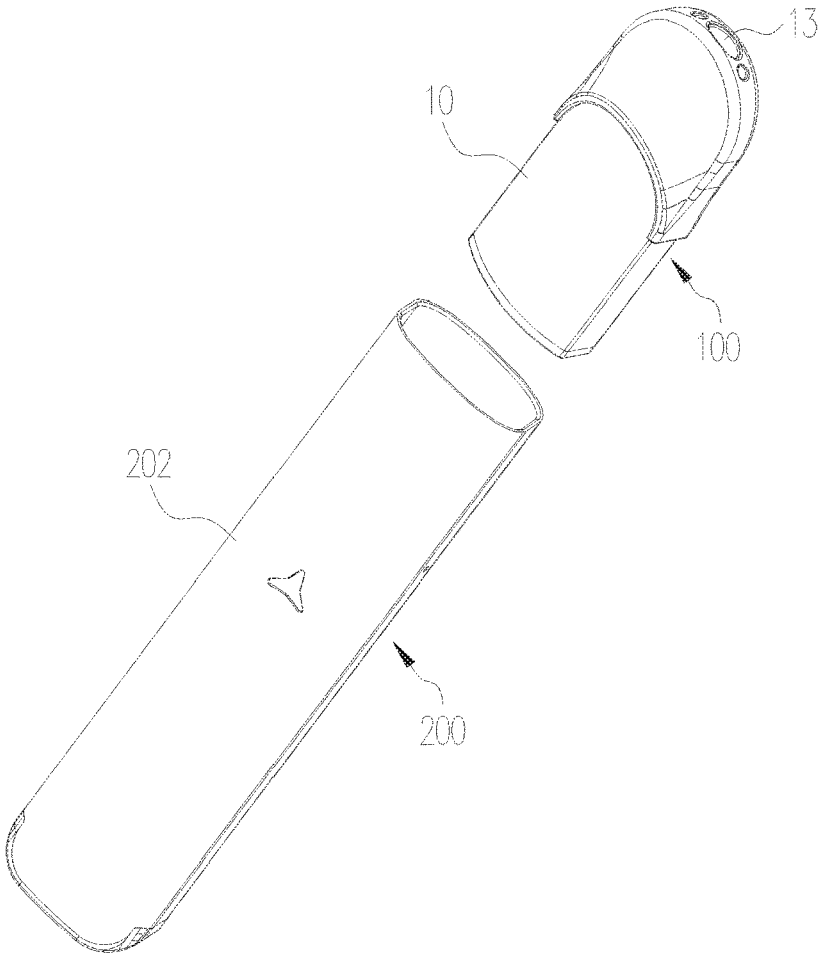
FIG. 1 is a partially exploded view of an aerosol generating device according to the present disclosure.
Figure 2:
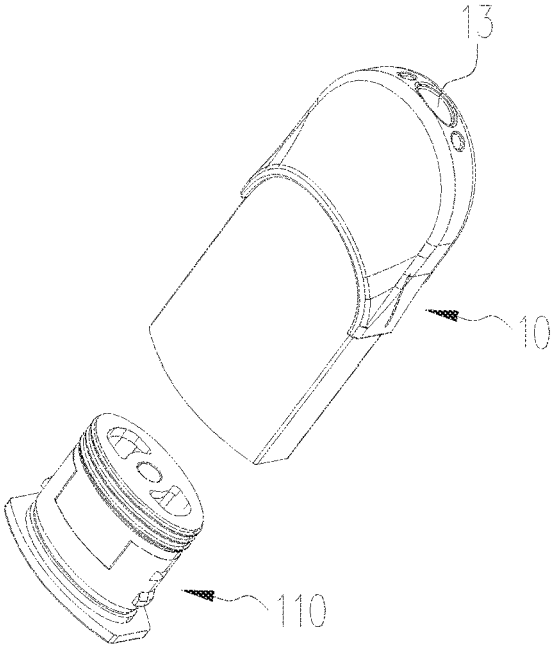
FIG. 2 is a partially exploded view of an atomizer of the aerosol generating device shown in FIG. 1.

Please refer to FIG. 1, this disclosure provides an aerosol generating device, the aerosol generating device includes an atomizer 100 and a power supply device 200 electrically connected to the atomizer 100. In use, the power supply device 200 provides power to the atomizer 100, the aerosol-forming substrate in the atomizer 100 is heated by the electric driving of the power supply device 200 and then atomized to form smoke, the smoke is mixed with external air under the suction of the user and then enters the mouth of the user for the user to inhale.

Please refer to FIGS. 2-5 and 9, the atomizer 100 includes a liquid storage member 10 and an atomizing assembly 110. A liquid storage chamber 101 is defined in the liquid storage member 10, and the liquid storage chamber 101 is configured to store the aerosol-forming substrate. The atomizing assembly 110 includes a heating assembly 30 and a sealing member 40. A receiving groove 401 is provided in the sealing member 40 and passes through the two ends of the sealing member 40. The receiving groove 401 has two open ends. The heating assembly 30 includes a liquid absorbing member 31 and a heating member 32. The liquid absorbing member 31 is installed in the receiving groove 401. The liquid absorbing member 31 includes a liquid absorbing surface 31A and an atomizing surface 31B which are respectively arranged toward the two open ends. The liquid absorbing surface 31A is configured to contact the aerosol-forming substrate. The heating member 32 is attached on the atomizing surface 31B or embedded in the atomizing surface 31B. A protrusion 311 is provided on the liquid absorbing surface 31A. The space defined by the receiving groove 401, the liquid absorbing surface 31A and the protrusion 311 constitutes a liquid inlet groove 402, and the liquid absorbing member 31 absorbs the aerosol-forming substrate through the liquid inlet groove 402. The liquid absorbing member 31 is made of a porous material. During operation, the liquid absorbing member 31 conducts the aerosol-forming substrate in the liquid storage chamber 101 to the atomizing surface 31B, so that the aerosol-forming substrate is atomized on the atomizing surface 31B to form smoke, and the smoke is provided for the user to inhale.

In the prior art, by reducing the physical thickness of the liquid absorbing member 31, the conduction distance of the aerosol-forming substrate can be shortened, thereby improving the conduction efficiency of the liquid absorbing member 31. However, since the physical thickness of the liquid absorbing member 31 is reduced, the structural strength of the liquid absorbing member 31 will be reduced. In addition, by increasing the physical thickness of the liquid absorbing member 31, although the structural strength of the liquid absorbing member 31 can be improved, the conduction distance of the aerosol-forming substrate will be increased, thereby reducing the conduction efficiency of the liquid absorbing member 31 and causing the part of the liquid absorbing member 31 in contact with the heating member 32 to be dry-burned. Thus, increasing the thickness of the liquid absorbing member 31 to improve the structural strength of the liquid absorbing member 31 and reducing the thickness of the liquid absorbing member 31 to improve the conduction efficiency of the liquid absorbing member 31 form two contradictory aspects. That is, in the prior art, the functions of enhancing the structural strength of the liquid absorbing member 31 and improving the conduction efficiency of the liquid absorbing member 31 cannot be achieved at the same time.

Figure 12:
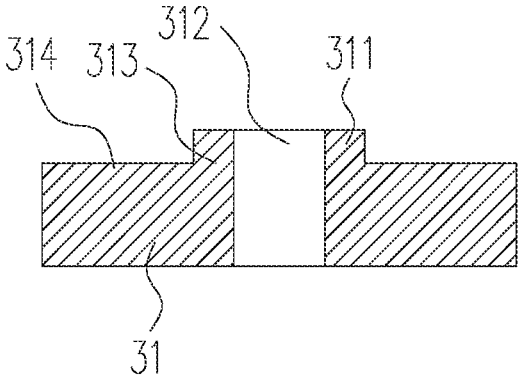

Please refer to FIG. 12, it should be noted that the part on the liquid absorbing member 31 that is connected to the protrusion 311 is a connecting portion 313 of the liquid absorbing member 31, and the part on the liquid absorbing member 31 that is not connected to the protrusion 311 is a free portion 314 of the liquid absorbing member 31. In the present disclosure, by providing the protrusion 311 on the liquid absorbing member 31, on the one hand, the thickness of the connecting portion 313 of the liquid absorbing member 31 is increased, thereby improving the structural strength of the connecting portion 313 of the liquid absorbing member 31, so that the connecting portion 313 of the liquid absorbing member 31 is not easily deformed or even broken, and on the other hand, the structural strength of the free portion 314 of the liquid absorbing member 31 is improved, so that the free portion 314 of the liquid absorbing member 31 is not easily deformed or even broken. Combining the above two aspects, by providing the protrusion 311 on the liquid absorbing member 31, the overall structural strength of the liquid absorbing member 31 is improved. The reason why the structural strength of the free portion 314 of the liquid absorbing member 31 is improved is that: according to the torque calculation formula: torque (M)=force (F)×arm of force (L), when the external force acts on the outermost side of the liquid absorbing member 31 in the axial direction, the arm of force is the largest. Under the premise that the magnitude, direction and point of action of the external force remain unchanged, after setting the protrusion 311, the deformation of the connecting portion 313 of the liquid absorbing member 31 is smaller than the deformation of the free portion 314 of the liquid absorbing member 31, the free portion 314 of the liquid absorbing member 31 is easily deformed or even broken relative to the connecting portion 313 of the liquid absorbing member 31, the fulcrum is moved from the connecting portion 313 of the liquid absorbing member 31 to the free portion 314 of the liquid absorbing member 31, the maximum arm of force of the free portion 314 of the liquid absorbing member 31 becomes smaller, and the torque received by the free portion 314 of the liquid absorbing member 31 becomes smaller. Therefore, the arrangement of the protrusion 311 improves the structural strength of the free portion 314 of the liquid absorbing member 31. Further, because the arrangement of the protrusion 311 improves the overall structural strength of the liquid absorbing member 31, there is no need to increase the physical thickness of the free portion 314 of the liquid absorbing member 31, and therefore, the conduction efficiency of the free portion 314 of the liquid absorbing member 31 to the aerosol-forming substrate is ensured. That is, the present disclosure achieves the effects of enhancing the structural strength of the liquid absorbing member 31 and improving the conduction efficiency of the liquid absorbing member 31 at the same time.

In a specific embodiment, the protrusion 311 is also made of a porous material and can absorb the aerosol-forming substrate. When the liquid absorbing member 31 absorbs the aerosol-forming substrate through the liquid inlet groove 402, the portion of the protrusion 311 where the liquid inlet groove 402 is formed is also in contact with the aerosol-forming substrate and absorbs the aerosol-forming substrate in the liquid inlet groove 402. In this embodiment, the protrusion 311 occupies a portion of the surface of the liquid absorbing surface 31A, so that the connecting portion 313 of the liquid absorbing member 31 cannot absorb the aerosol-forming substrate. Since the absorbing effect of the protrusion 311 to the aerosol-forming substrate compensates for the area loss of the liquid absorbing surface of the connecting portion 313 of the liquid absorption member 31, the quantity requirement for the liquid absorbing member 31 to absorb the aerosol-forming substrate is guaranteed.

In a specific embodiment, the liquid absorbing member 31 and the protrusion 311 are both made of porous ceramic material. In the existing aerosol generating device, the liquid absorbing member 31 and the protrusion 311 are usually made of fiber cotton material, when the aerosol generating device outputs high power, it is easy to cause the liquid absorbing member 31 and the protrusion 311 to burn due to lack of liquid. In the present disclosure, the liquid absorbing member 31 and the protrusion 311 are made of porous ceramic material and the porous ceramic material has high temperature resistance relative to the fiber cotton material, so as to effectively prevent the liquid absorbing member 31 and the protrusion 311 from being scorched, and improve the smoking taste of the user. It is understood that, in other embodiments, the liquid absorbing member 31 and the protrusion 311 can also be made of liquid absorbing material such as porous graphite or foamed metal.

It is understood that, in other embodiments, the protrusion 311 can also be made of a material that does not have the ability to absorb the aerosol-forming substrate, for example, high temperature resistant plastic or stainless steel. In addition, in a specific embodiment, the protrusion 311 and the liquid absorbing member 31 are integrally formed, which is convenient to manufacture and beneficial to cost saving. It is understood that, in other embodiments, the liquid absorbing member 31 and the protrusion 311 can also be separate parts, and in use, it only needs to connect the two, wherein the connection mode between the liquid absorbing member 31 and the protrusion 311 includes but is not limited to threaded connection, clamping, or pressing, etc., which is not limited herein.

Figure 5:
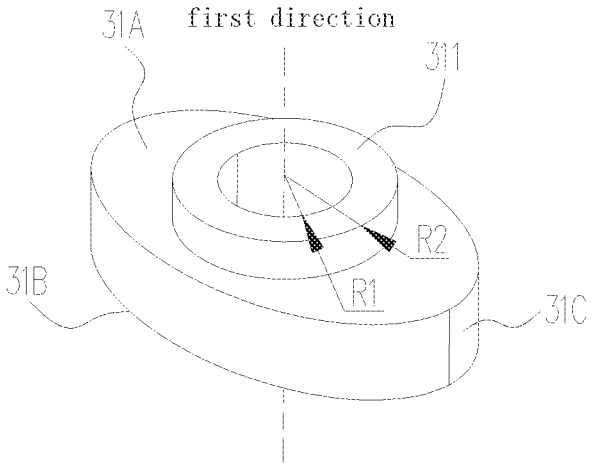
FIG. 5 is a schematic diagram of the connection structure between the liquid absorbing member and the protrusion of the atomizing assembly shown in FIG. 3.
Figure 6:
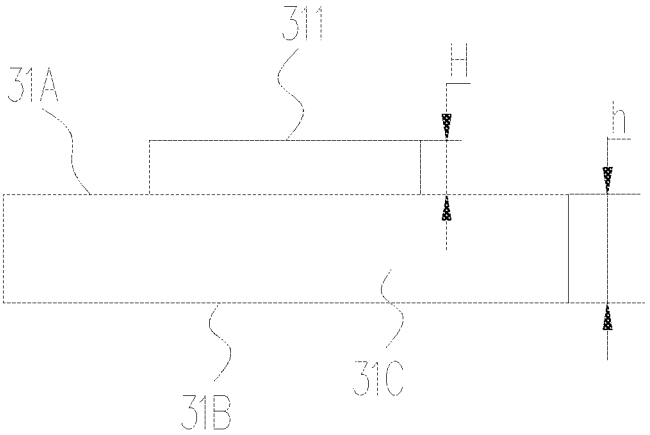
FIG. 6 is a front view of the connecting structure of the liquid absorbing member and the protrusion shown in FIG. 5.
Figure 7:
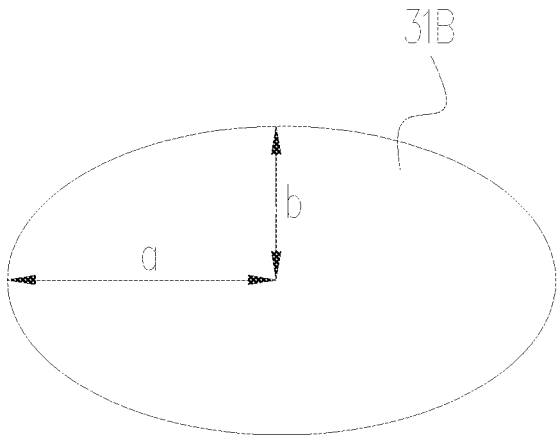

Referring to FIGS. 5-7, in a specific embodiment, the liquid absorbing member 31 further includes a connecting surface 31C connected between the liquid absorbing surface 31A and the atomizing surface 31B, and the liquid absorbing surface 31A and the atomizing surface 31B are arranged opposite to each other. In this embodiment, the liquid absorbing surface 31A and the atomizing surface 31B are both flat and parallel to each other, so that the conduction efficiency of the aerosol-forming substrate conducted from everywhere on the liquid absorbing surface 31A to the oppositely disposed atomizing surface 31B is consistent or tends to be consistent. It is ensured that the quantity of the aerosol-forming substrate conducted to various places on the atomizing surface 31B is basically the same, which is beneficial to the uniform atomizing of the aerosol-forming substrate.

In addition, the direction in which the atomizing surface 31B faces the liquid absorbing surface 31A is defined as the first direction of the liquid absorbing member 31. The protrusion 311 protrudes on the liquid absorbing surface 31A along the first direction of the liquid absorption member 31. It is understood that, the center position of the liquid absorbing member 31 is most likely to be deformed or even broken. The protrusion 311 is located at the center of the liquid absorbing surface 31A, the protrusion 311 reduces the deformation of the center position of the liquid absorbing member 31, so that the setting of the protrusion 311 has a more obvious effect on improving the structural strength of the liquid absorbing member 31. It is understood that any cross section of the liquid absorbing member 31 along a direction perpendicular to the first direction can be a circle, an ellipse, or a polygon such as a triangle, a rectangle, a trapezoid, or a pentagon, which is not limited herein. When the shape of cross section of the liquid absorbing member 31 along a direction perpendicular to the first direction is a circle or an ellipse, compared with polygonal shapes such as triangles and rectangles, the outer edge of circle or ellipse is smoothly transitioned and connected without transitional angles, which is easy to manufacture and can prevent the material of the liquid absorbing member 31 from falling off. In addition, the shape of any cross section of the protrusion 311 along a direction perpendicular to the first direction can be any of the above-mentioned shapes.

In a specific embodiment, the dimension between the atomizing surface 31B and the liquid absorbing surface 31A along the first direction of the liquid absorbing member 31 is the height h (unit: mm) of the liquid absorbing member 31, the height h of the liquid absorbing member 31 is greater than or equal to 1.5 mm, and the height h of the liquid absorbing member 31 is less than or equal to 5 mm, that is, $1.5\ \text{mm} \le h \le 5\ \text{mm}$, wherein in this embodiment, h=2.1 mm. In this way, the height h of the liquid absorbing member 31 is controlled in a reasonable height. On the one hand, it is avoided that the height h of the liquid absorbing member 31 is too small, causing difficulty in demolding when the liquid absorbing member 31 is formed, and the structural strength of the liquid absorbing member 31 is insufficient. On the other hand, it is avoided that that the height h of the liquid absorbing member 31 is too large, resulting in an excessively long conduction distance of the aerosol-forming substrate, and the conduction efficiency of the liquid absorbing member 31 is reduced, and the part of the liquid absorbing member 31 in contact with the heating member 32 is dried out.

In a specific embodiment, the dimension of the protrusion 311 along the first direction of the liquid absorbing member 31 is the height H (unit: mm) of the protrusion 311. The area of any cross section of the protrusion 311 along a direction perpendicular to the first direction of the liquid absorbing member 31 is S (unit: $mm^2$), and $S/H \ge 10$. In this way, the reasonable ratio of H to S is controlled to ensure the structural strength of the protrusion 311. In this embodiment, the protrusion 311 has a tubular structure with both ends penetrating through, and H=1.1 mm. The radius of the inner ring of the protrusion 311 is R1=1.6 mm, the radius of the outer ring of the protrusion 311 is R2=2.65 mm, and $S=14.02\ mm^2$.

In a specific embodiment, the ratio of the height H of the protrusion 311 to the height h of the liquid absorbing member 31 is greater than or equal to 0.25 and less than or equal to 0.75. That is, $0.25 \le H/h \le 0.75$. In this embodiment, the height of the protrusion 311 is H=1.1 mm, and the height of the liquid absorbing member 31 is h=2.1 mm.

In a specific embodiment, the area of any cross section of the liquid absorbing member 31 along a direction perpendicular to the first direction is s (unit: $mm^2$), and $0.2 \le S/s \le 0.5$. In this way, the reasonable ratio of S and s is controlled to ensure the connection strength of the connection portion between the protrusion 311 and the liquid absorbing member 31, and to ensure that there is a sufficiently large liquid absorbing area on the liquid absorbing surface 31A. In this embodiment, the shape of any cross section of the liquid absorbing member 31 along a direction perpendicular to the first direction is an ellipse, the major semi-axis of the ellipse a=5.475 mm, the minor semi-axis of the ellipse b=3.425 mm, $s=58.91\ mm^2$, S/s=0.238.

In a specific embodiment, the liquid absorbing surface 31A is arranged facing the liquid storage chamber 101 and is located directly below the liquid storage chamber 101. The atomizing surface 31B is arranged opposite to the liquid storage chamber 101. During use, the aerosol-forming substrate in the liquid storage chamber 101 flows out of the liquid storage chamber 101 under the action of gravity, and then comes into contact with the liquid absorbing surface 31A. The aerosol-forming substrate is conducted to the atomizing surface 31B under the action of the liquid absorbing member 31. In this way, the transfer direction of the aerosol-forming substrate from the liquid absorbing surface 31A to the atomizing surface 31B is the same as the gravity direction of the aerosol-forming substrate, which increases the conduction rate of the aerosol-forming substrate in the liquid absorbing member 31 and ensures that the aerosol-forming substrate on the atomizing surface 31B can be continuously supplied. On the one hand, the aerosol-forming substrate on the atomizing surface 31B can be effectively prevented from being exhausted, and on the other hand, the aerosol-forming substrate in the liquid storage chamber 101 can be fully utilized, and the waste of the aerosol-forming substrate in the liquid storage chamber 101 can be reduced.

Figure 4:
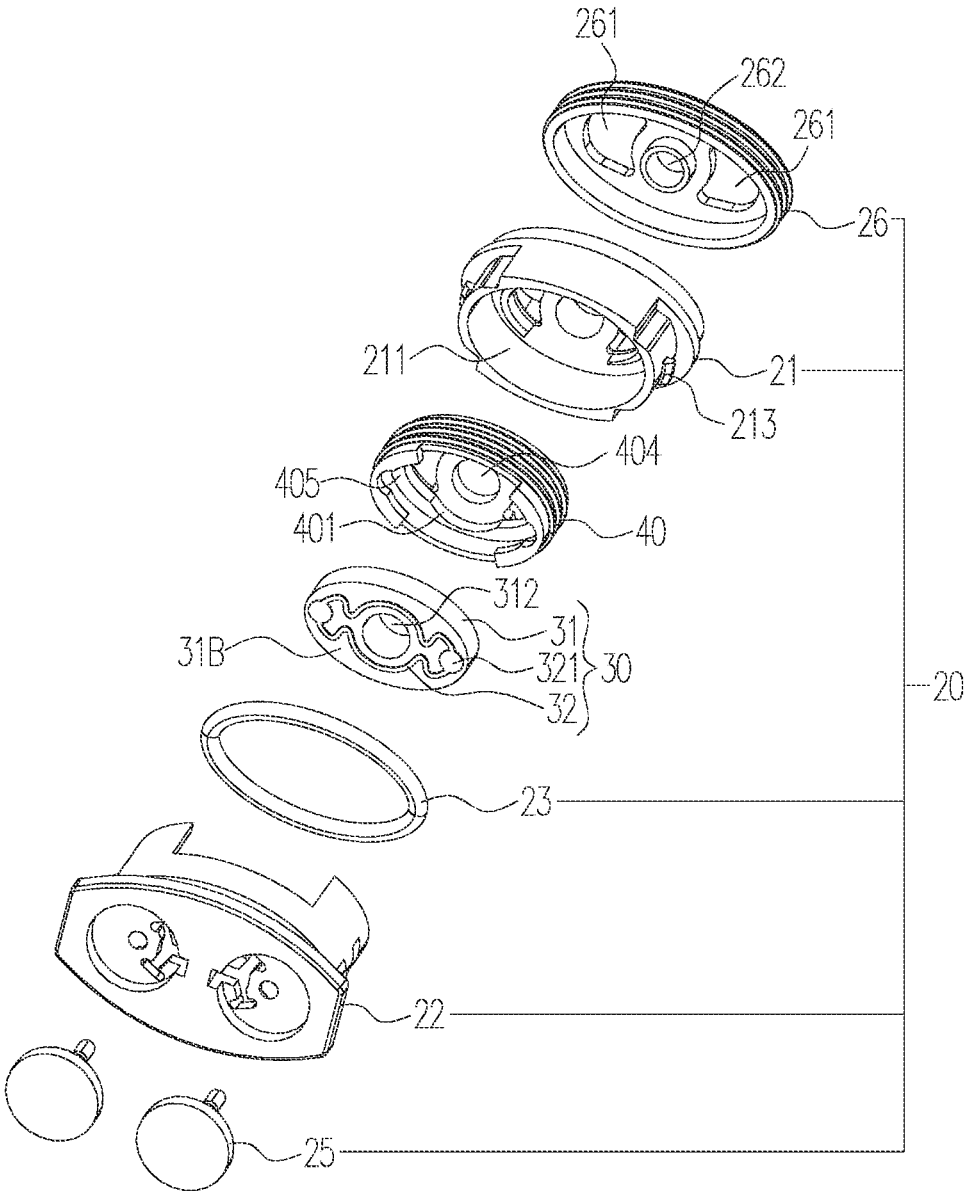
FIG. 4 is an exploded view of the atomizing assembly of the atomizer shown in FIG. 2 from another viewing angle.

Please refer to FIG. 4, the heating member 32 is configured to heat the aerosol-forming substrate. Specifically, the heating member 32 is electrically connected to the power supply device 200. Under the electric driving of the power supply device 200, the heating member 32 heats the aerosol-forming substrate having been conducted to the atomizing surface 31B, so that the aerosol-forming substrate is atomized to generate smoke.

In a specific embodiment, the heating member 32 can be a heat-generating coating, a heating circuit, a heating sheet, or a heating net. Specifically, the heat-generating coating can be coated on the atomizing surface 31B by a thick film process or a thin film process. The heating circuit can be formed on the atomizing surface 31B through a laser activated rapid metallization process. The heating sheet or heating net can be installed on the atomizing surface 31B through other auxiliary installation structures, the auxiliary installation structures include but are not limited to screws, bolts, locking structures, etc. The heating sheet or heating net can also be embedded in the liquid absorbing member 31 in the form of an insert.

In a specific embodiment, the shape of the heating member 32 can be elongated, curved, round, etc. It is understood that, FIG. 4 is only configured to illustrate that the heating member 32 is arranged on the atomizing surface 31B, the shape of the heating member 32 is not specifically limited herein, and the specific shape of the heating member 32 can be changed according to specific design requirements. In this embodiment, the heating member 32 has a flat structure, and can fully contact the atomizing surface 31B, so that the atomizing surface 31B is evenly heated. In this way, the temperature of the atomizing is relatively consistent, and the atomized particles will not be large due to low local temperature, to effectively ensure the uniformity of the atomized particles and improve the smoking taste. At the same time, the heating member 32 has a large contact area with the aerosol-forming substrate, thereby improving the atomizing efficiency.

Please refer to FIG. 9 again, in a specific embodiment, an air guiding passage 312 is provided in the liquid absorbing member 31, one end of the air guiding passage 312 extends through the atomizing surface 31B, and the other end of the air guiding passage 312 extends through the outer surface of the protrusion 311. In this embodiment, the air guiding passage 312 extends through the upper end surface of the protrusion 311. When the user inhales, under the suction action of the user, the smoke formed by the aerosol-forming substrate flows in through one end of the air guiding passage 312 that extends through the atomizing surface 31B; then, the smoke flows out from one end of the air guiding passage 312 that extends through the upper end surface of the protrusion 311, and the smoke contacts the passage wall of the air guiding passage 312. Since the liquid absorbing member 31 is stored with the aerosol-forming substrate, when the smoke flows through the air guiding passage 312 and the smoke contacts the passage wall of the air guiding passage 312, the aerosol-forming substrate stored on the passage wall of the air guiding passage 312 has a humidifying effect to the smoke, thereby increasing the humidity when the smoke flows out, and improving the inhaling taste of the smoke. Since the part of the liquid absorbing member 31 closer to the liquid storage chamber 101 has a lower temperature, the part of the liquid absorbing member 31 closer to the liquid storage chamber 101 is stored with a larger quantity of e-liquid. In this way, when the smoke flows through the air guiding passage 312, the humidity of the smoke will only gradually increase, which prevents the smoke from being dried when it flows out of the air guiding passage 312. In addition, when the protrusion 311 is made of a liquid-absorbing material, when the smoke passes through the air guiding passage 312 at the position corresponding to the protrusion 311, the smoke can be further humidified by the aerosol-forming substrate stored on the protrusion 311, thereby further increasing the humidity of the smoke and ensuring the inhaling taste.

Figure 3:
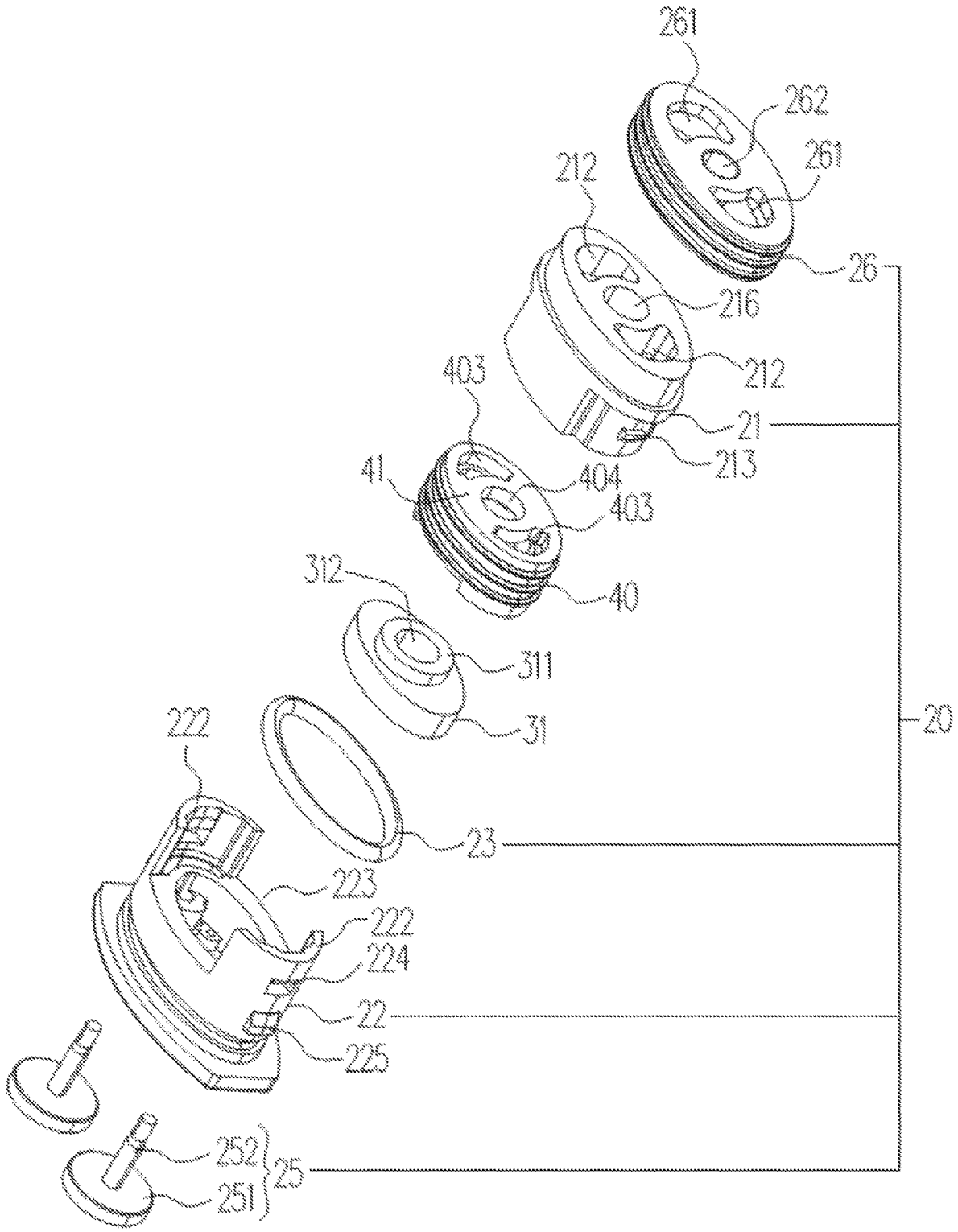
FIG. 3 is an exploded view of an atomizing assembly of the atomizer shown in FIG. 2.
Figure 9:
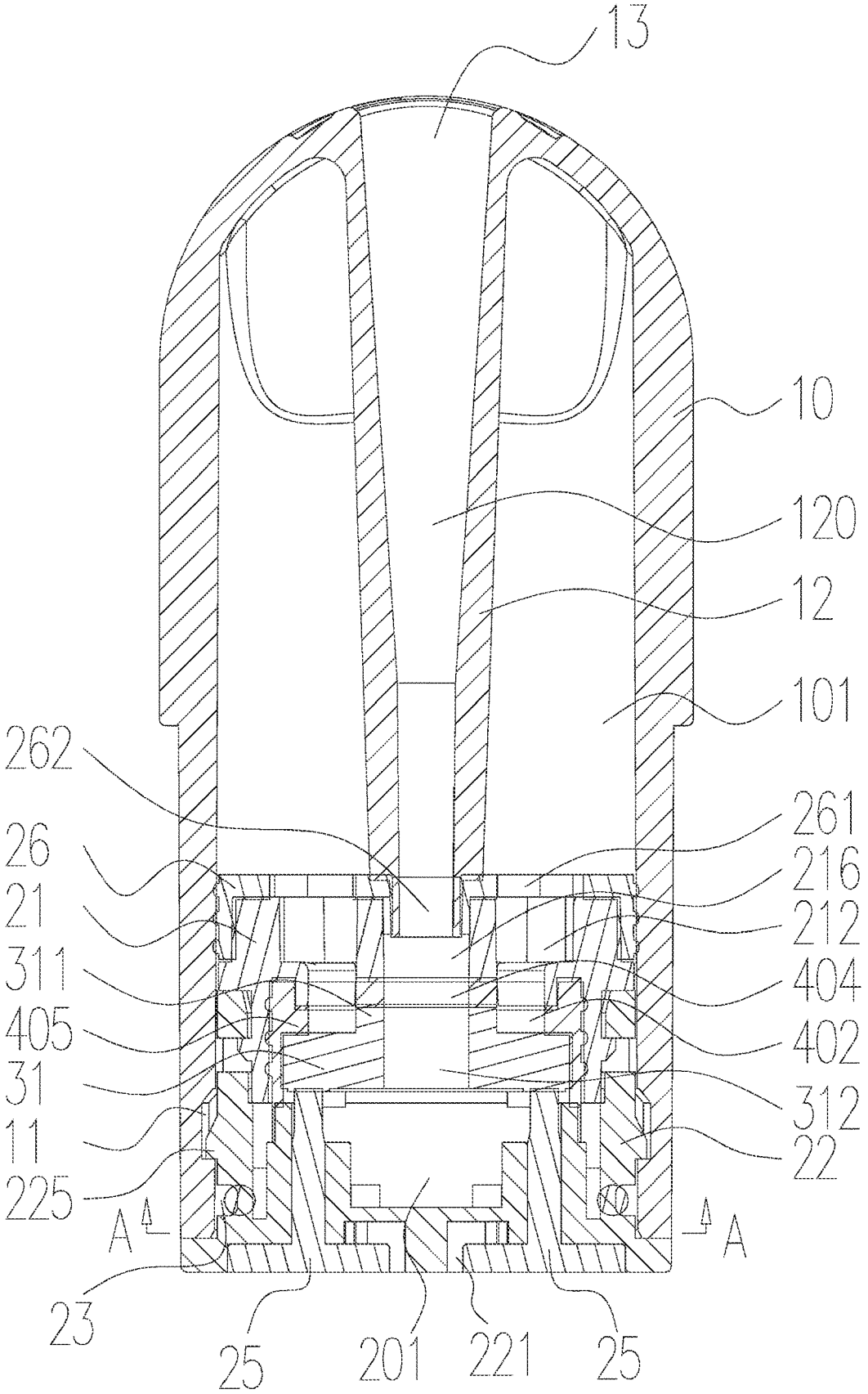

Please refer to FIG. 3, FIG. 4 and FIG. 9, in a specific embodiment, the sealing member 40 has generally a hollow cylindrical structure with both ends being opened. The receiving groove 401 is formed by the inner cavity of the sealing member 40, and the receiving groove 401 is configured for installing the liquid absorbing member 31 and the protrusion 311. When the liquid absorbing member 31 is installed in the receiving groove 401, the connecting surface 31C of the liquid absorbing member 31 abuts against the groove wall of the receiving groove 401, so as to improve the sealing performance and prevent the leakage of e-liquid. Specifically, the liquid inlet groove 402 is formed by a space surrounded by the groove wall of the receiving groove 401, the liquid absorbing surface 31A, and the outer wall of the protrusion 311. In this embodiment, in order to prevent the aerosol-forming substrate in the liquid inlet groove 402 from flowing through the upper end surface of the protrusion 311 and then leaking into the air guiding passage 312, a sealing plate 41 is provided on the open end of the sealing member 40 close to the liquid absorbing surface 31A, and the upper end surface of the protrusion 311 abuts against the lower end surface of the sealing plate 41, thereby improving the sealing performance. The sealing member 40 is made of a sealing material such as silicone or rubber to improve the sealing performance. In addition, since the atomizing surface 31B is not covered by the sealing member 40, the heating member 32 provided on the atomizing surface 31B is avoided to heat the sealing member 40 to cause the sealing member 40 to fail.

In addition, the sealing plate 41 is provided with a communication hole 403, and the communication hole 403 is in communication with the liquid inlet groove 402. In use, the aerosol-forming substrate in the liquid storage chamber 101 passes through the communication hole 403 and the liquid inlet groove 402 in sequence: and then is absorbed by the liquid absorbing member 31. At the same time, in order to facilitate the discharge of the smoke, the sealing plate 41 is further provided with an air discharge hole 404, and the air discharge hole 404 is in communication with one end of the air guiding passage 312 extending through the upper end surface of the protrusion 311. It is understood that the receiving groove 401 extends through the end surface of the sealing member 40 close to the liquid absorbing surface 31A through the communication hole 403.

In a specific embodiment, there are two communication holes 403, so that the aerosol-forming substrate in the liquid storage chamber 101 can enter the liquid inlet groove 402 synchronously and uniformly from both sides of the sealing member 40; thus, the atomizing of the heating assembly 30 is more uniform. It is understood that, in other embodiments, the sealing plate 41 and the communication hole 403 can also be omitted. The aerosol-forming substrate directly enters the liquid inlet groove 402 through the open end of the receiving groove 401 close to the liquid absorbing surface 31A, and contacts the liquid absorbing member 31 and is absorbed.

Please refer to FIG. 3, FIG. 4 and FIG. 9, the atomizing assembly 110 further includes a base assembly 20, an atomizing cavity 201 is provided in the base assembly 20, the heating member 30 and the sealing member 40 are both arranged in the base assembly 20, and the smoke formed by the aerosol-forming substrate is filled in the atomizing cavity 201. The base assembly 20 is installed at one end of the liquid storage member 10, and the liquid storage chamber 101 is formed by a space enclosed by the base assembly 20 and the liquid storage member 10.

The base assembly 20 includes an atomizing bracket 21 and an atomizing seat 22, the atomizing bracket 21 is connected to the atomizing seat 22, the atomizing cavity 201 is formed between the atomizing bracket 21 and the atomizing seat 22, and the heating assembly 30 and the sealing member 40 are sandwiched between the atomizing bracket 21 and the atomizing seat 22. The atomizing bracket 21 is arranged close to the liquid storage chamber 101 relative to the atomizing seat 22, the end surface of the atomizing bracket 21 facing the atomizing seat 22 is provided with a mounting groove 211, the mounting groove 211 is configured to install the sealing member 40, a liquid inlet hole 212 is provided on the end surface of the atomizing bracket 21 facing the liquid storage chamber 101, and the liquid inlet hole 212 is in communication with the liquid storage chamber 101 and the communication hole 403. In use, the heating assembly 30 is firstly installed in the receiving groove 401, and then, the assembly structure of the heating assembly 30 and the sealing member 40 is installed in the mounting groove 211; the aerosol-forming substrate in the liquid storage chamber 101 passes through the liquid inlet hole 212, the communication hole 403 and the liquid inlet groove 402 in sequence, and then is absorbed by the liquid absorbing member 31. In a specific embodiment, there are two liquid inlet holes 212 which are arranged symmetrically with respect to the central axis of the atomizing bracket 21. One of the liquid inlet holes 212 is in communication with a corresponding one of the communicating holes 403. In addition, when the assembly structure of the sealing member 40 and the heating assembly 30 is installed in place with the atomizing bracket 21, the sealing member 40 is sandwiched between the liquid absorbing member 31 and the atomizing bracket 21, which can effectively prevent the aerosol-forming substrate from leaking between the connecting surface 31C of the liquid absorbing member 31 and the groove wall of the mounting groove 211, thereby improving the sealing performance.

In a specific embodiment, the end surface of the atomizing bracket 21 facing the liquid storage chamber 101 is further provided with an air outlet hole 216, the air outlet hole 216 and the air discharge hole 404 are aligned and communicated, so as to realize the communication relationship between the air outlet hole 216 and the air guiding passage 312 through the air discharge hole 404, so as to facilitate the smoke to flow out after passing through the air outlet hole 216. It can be seen from the above that, in other embodiments, the receiving groove 401 may also penetrate through the end surface of the sealing member 40 close to the liquid storage chamber 101, and in this condition, the air discharge hole 404 may be omitted, the protrusion 311 extends axially and upward along the first direction of the liquid absorbing member 31, and the upper end surface of the protrusion 311 abuts against the top wall of the atomizing bracket 21. At this time, the air outlet hole 216 is directly in communication with one end of the air guiding passage 312 which extends through the upper end surface of the protrusion 31.

The atomizing seat 22 is arranged away from the liquid storage chamber 101 relative to the atomizing bracket 21, and the atomizing cavity 201 is formed in the atomizing seat 22. Specifically, the atomizing seat 22 is provided with an opening facing the atomizing bracket 21, and the atomizing cavity 201 is formed by the opening of the atomizing seat 22. When the heating member 30, the sealing member 40 and the base assembly 20 are installed in place, the liquid absorbing member 31 isolates the liquid storage chamber 101 from the atomizing cavity 201, so that the aerosol-forming substrate stored in the liquid storage chamber 101 is completely isolated from the air in the atomizing cavity 201. In this way, when the aerosol generating device is used, no matter what posture the aerosol generating device is used or shaken or placed, the aerosol-forming substrate in the liquid storage chamber 101 will not leak.

In a specific embodiment, connecting plates 222 are protrudingly provided in the direction toward the atomizing bracket 21 on opposite outer edges of the end face of the atomizing seat 22 facing the atomizing bracket 21. The space between the two connecting plates 222 forms a mounting cavity 223, and the mounting cavity 223 is configured for installing the atomizing bracket 21. Specifically, the end of the atomizing bracket 21 away from the liquid storage chamber 101 is inserted into the mounting cavity 223, the end surface of the atomizing bracket 21 away from the liquid storage chamber 101 abuts against the end surface of the atomizing seat 22 close to the liquid storage chamber 101, so that the connection between the atomizing bracket 21 and the atomizing seat 22 is realized while facilitating the user's operation of installation.

In a specific embodiment, a first latching tab 213 is provided on the side wall of the atomizing bracket 21, the outer wall of the connecting plate 222 is provided with a first latching groove 224, the first latching tab 213 and the first latching groove 224 are engaged with each other, thereby improving the stability of the connection between the atomizing bracket 21 and the atomizing seat 22. In addition, a second latching tab 225 is also provided on the outer wall of the connecting plate 222, the inner wall of the liquid storage member 10 is provided with a second latching groove 11. During installation, the base assembly 20 is received in one end of the liquid storage member 10, and the second latching tab 225 is engaged with the second latching groove 11, thereby improving the stability of the connection between the base assembly 20 and the liquid storage member 10. In addition, a sealing ring 23 is sandwiched between the outer wall of the atomizing seat 22 and the inner wall of the liquid storage member 10. The sealing ring 23 is configured to improve the sealing performance of the connection between the atomizing seat 22 and the liquid storage member 10 to prevent the leakage of the aerosol-forming substrate. It is understood that, the material of the sealing ring 23 is silicone or rubber.

The base assembly 20 further includes conductive members 25, the conductive members 25 are configured to conduct electricity. There are two conductive members 25, one of them is used as the positive electrode, and the other is used as the negative electrode. Specifically, the conductive members 25 are inserted into the atomizing seat 22 from the lower end surface of the atomizing seat 22, pass through the atomizing cavity 201 and abut against the electrode connecting ends 321 of the heating member 32, to realize the electrical connection between the conductive members 25 and the heating member 32.

In a specific embodiment, there are two electrode connecting ends 321 of the heating member 32, the two electrode connecting ends 321 are respectively located on opposite outer edges of the atomizing surface 31B, ensuring that the area of the heating member 32 between the two electrode connecting ends 321 is as large as possible, thereby increasing the atomizing area. In this way, the two conductive members 25 respectively press on the two opposite outer edges of the atomizing surface 31B. At the same time, the groove wall of the receiving groove 401 is protrudingly and oppositely provided with two resisting protrusions 405. One resisting protrusion 405 is corresponding to one of the electrode connecting ends 321. When the liquid absorbing member 31 is installed in the receiving groove 401, the outer edge of the liquid absorbing surface 31A of the liquid absorbing member 31 abuts against the lower surface of the resisting protrusion 405. In this way, the outer edge of the liquid absorbing member 31 is simultaneously subjected to the pressing force of the conductive member 25 and the resisting force of the resisting protrusion 405. The pressing force and the resisting force received by the liquid absorbing member 31 are balanced to each other, and the resultant force is zero, thereby preventing a torque from being applied to the liquid absorbing member 31, thereby preventing the liquid absorbing member 31 from being deformed or even broken.

In this embodiment, the two electrode connecting ends 321 are both located on the free portion 314 of the liquid absorbing member 31, and the two conductive members 25 press on the free portion 314 of the liquid absorbing member 31.

In this embodiment, the shape of any cross section of the liquid absorbing member 31 along a direction perpendicular to the first direction is an ellipse, the two electrode connecting ends 321 of the heating member 32 are roughly located at the focal points of the ellipse. That is, the two electrode connecting ends 321 of the heating member 32 are roughly located at the two ends of the major axis of the ellipse. Compared with the liquid absorbing member with a circular cross section, the distance between the two electrode connecting ends 321 is elongated, thereby facilitating the arrangement of the conductive members 25.

Figure 8:
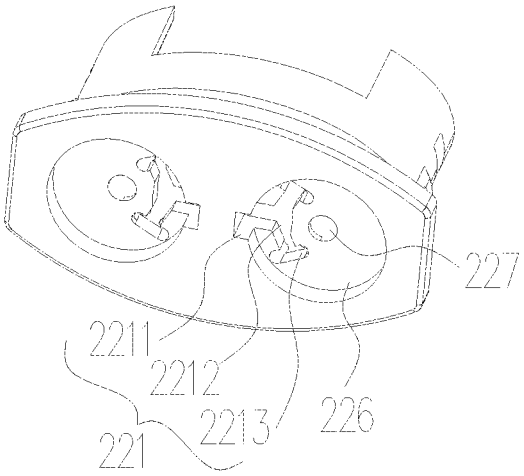
Figure 10:
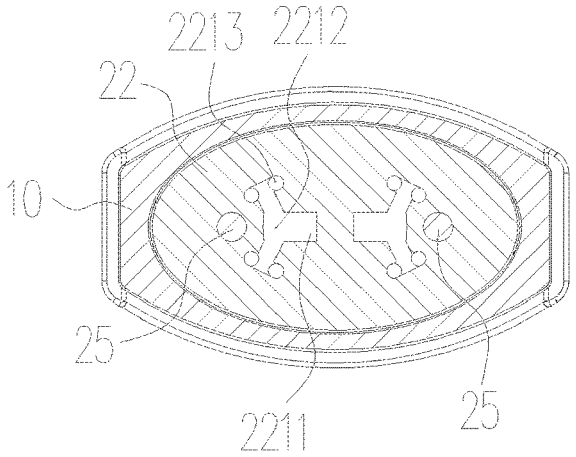
Figure 11:
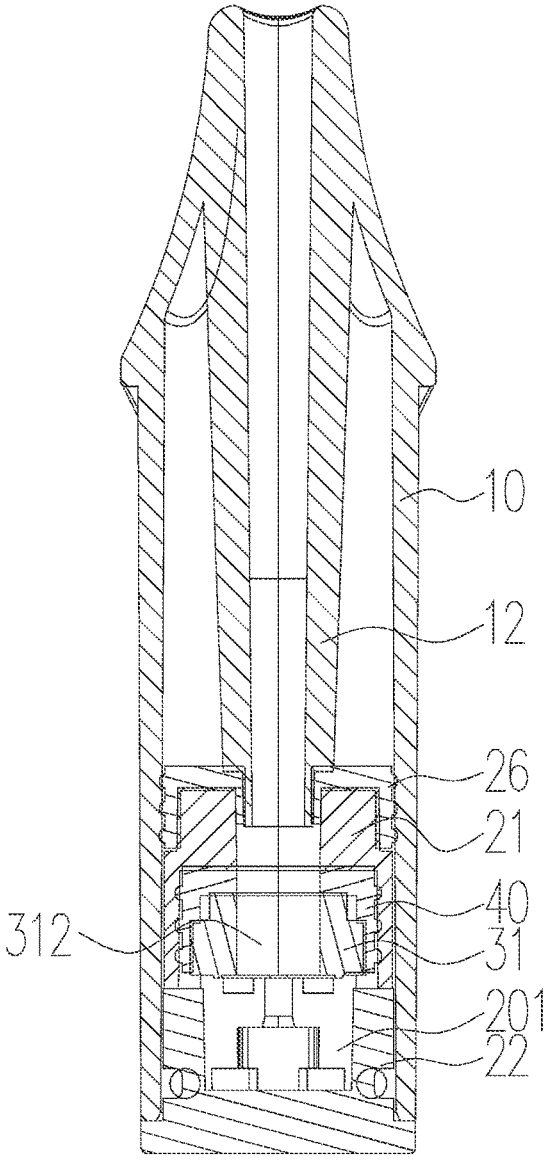

Please refer to FIGS. 8, and 10, in a specific embodiment, a mating groove 226 is provided on the end surface of the atomizing seat 22 away from the liquid storage chamber 101, and a through hole 227 is provided on the top wall of the mating groove 226. The conductive member 25 includes a conductive plate 251 and a conductive column 252 which are connected to each other, and the outer diameter of the conductive plate 251 is larger than the outer diameter of the conductive post 252. The conductive plate 251 is engaged with the mating groove 226. The conductive column 252 is engaged with the through hole 227. In use, the end of the conductive column 252 away from the conductive plate 251 passes through the through hole 227 and abuts against the electrode connecting end 321, and the conductive plate 251 is fitted in the mating groove 226. In addition, the outer diameter of the conductive plate 251 is larger than the outer diameter of the conductive column 252, which increases the contact area between the conductive member 25 and a conductive column of the power supply device 200, which can effectively prevent poor contact due to assembly errors.

In addition, the end of the atomizing seat 22 away from the liquid storage chamber 101 is provided with an air inlet passage 221, the air inlet passage 221 is in communication with the outside atmosphere and the atomizing cavity 201. When the user inhales, external air enters the atomizing chamber 201 through the air inlet passage 221 and mixes with the smoke; the mixed smoke passes through the air guiding passage 312, the air discharge hole 404 and the air outlet hole 216 in sequence, and then flows out to the outside of the atomizing bracket 21. In a specific embodiment, the groove side wall of the mating groove 226 is recessed to form an air inlet groove 2211, the groove top wall of the mating groove 226 is recessed to form an air guiding groove 2212, the air guiding groove 2212 is a blind groove and in communication with the air inlet groove 2211. The groove top wall of the air guiding groove 2212 is provided with a plurality of air inlet holes 2213. The air inlet hole 2213 is in communication with the atomizing cavity 201 and the air guiding groove 2212. The air inlet passage 221 is constituted by the air inlet groove 2211, the air guiding groove 2212 and the air inlet hole 2213. In this embodiment, the air guiding groove 2212 has a substantially Y-shaped structure, one of the branches of the Y-shaped structure is in communication with the air inlet groove 2211, and an air inlet hole 2213 is provided on each of the other two branches of the Y-shaped structure, so that external air can enter the atomizing cavity 201 from different air inlet holes 2213 respectively, which ensures that the amount of air intake in the atomizing cavity 201 is consistent or tends to be consistent, thereby making the atomizing more uniform. It is understood that, in other embodiments, the air inlet passage 221 can also be a communicating hole directly opened at the end of the atomizing seat 22 away from the liquid storage chamber 101. The structure and location of the air inlet passage 221 are not limited, as long as the external air communicates with the atomizing cavity 201 through the air inlet passage 221.

In a specific embodiment, the base assembly 20 further includes a sealing sleeve 26, the sealing sleeve 26 is sleeved on the outside of the upper end of the atomizing bracket 21, the sealing sleeve 26 is configured to improve the sealing performance between the liquid storage member 10 and the atomizing bracket 21. The sealing sleeve 26 is provided with a liquid inlet opening 261 corresponding to the liquid inlet hole 212, so that the aerosol-forming substrate can pass through the sealing sleeve 26. The sealing sleeve 26 is provided with an air outlet opening 262 corresponding to the air outlet hole 216 to facilitate the smoke to pass through the sealing sleeve 26. The sealing sleeve 26 is made of a material with sealing performance. In this embodiment, the sealing sleeve 26 is made of silicone. It is understood that, in other embodiments, the sealing sleeve 26 and the atomizing bracket 21 are integrally formed.

The liquid storage member 10 is configured to provide an aerosol-forming substrate to the atomizer 100, the liquid storage member 10 is generally a hollow cylindrical structure with an opening at the lower end, the base assembly 20 is installed in the opening at the lower end of the liquid storage member 10. The upper end surface of the liquid storage member 10 extends downward to from a vent tube 12, the vent tube 12 has a tubular structure with both ends being opened. The upper end of the vent tube 12 extends through the upper end surface of the liquid storage member 10 and is in communication with the outside atmosphere. The opening at the upper end of the vent tube 12 forms a smoke outlet opening 13, the lower end of the vent tube 12 is in communication with the air outlet hole 216 of the atomizing bracket 21. The inner cavity of the vent tube 12 forms a smoke outlet passage 120. The smoke outlet passage 120 is in communication with the air outlet hole 216 and the smoke outlet opening 13.

Please refer to FIG. 1 again, the power supply device 200 includes a battery housing 202 and a battery installed in the battery housing 202, the battery housing 202 is connected with the liquid storage member 10 to realize the connection relationship between the power supply device 200 and the atomizer 100. It is understood that the power supply device 200 and the atomizer 100 can be connected in a detachable manner such as plug connection, screw connection, snap connection, or magnetic connection, which is not limited herein. In addition, the battery is electrically connected to the heating member 32 of the heating assembly 30 through the conductive members 25.

In use, the aerosol-forming substrate in the liquid storage chamber 101 enters the liquid inlet groove 402 through the liquid inlet opening 261, the liquid inlet hole 212 and the communication hole 403 in sequence, and then comes into contact with the liquid absorbing member 31; the liquid absorbing surface 31A conducts the aerosol-forming substrate to the atomizing surface 31B, and the heating member 32 arranged on the atomizing surface 31B atomizes the aerosol-forming substrate to form smoke under the electric driving of the power supply device 200, and the smoke is filled in the atomizing cavity 210. When the user sucks, the external air enters the atomizing cavity 201 through the air inlet passage 221 and mixes with the smoke under the user's suction action; the mixed smoke flows out through the air guiding passage 312, the air discharge hole 404, the air outlet hole 216 and the air outlet opening 262 in sequence, and finally flows into the user's mouth from the smoke outlet opening 13 through the smoke outlet passage 120.

In the atomizer 100 provided by the present disclosure, the arrangement of the protrusion 311 improves the structural strength of the liquid absorbing member 31. Further, since the protrusion 311 improves the structural strength of the liquid absorbing member 31, there is no need to increase the physical thickness of the liquid absorbing member 31, thereby ensuring the conduction efficiency of the liquid absorbing member 31 to the aerosol-forming substrate. That is, the present disclosure achieves the effects of enhancing the structural strength of the liquid absorbing member 31 and improving the conduction efficiency of the liquid absorbing member 31 at the same time.

The aerosol generating device provided by the present disclosure has all the technical features of the above-mentioned atomizer 100, so it has the same technical effects as the above-mentioned atomizer 100.

Taking the above-mentioned ideal embodiments according to the present disclosure as enlightenment, through the above description, the relevant staff can make various changes and modifications without departing from the concept of the present disclosure. The technical scope of the present disclosure is not limited to the content of the specification, and its technical scope must be determined according to the scope of the claims.

What is claimed is:

1. An atomizing assembly for an atomizer, wherein the atomizer comprises a liquid storage member and the atomizing assembly, the liquid storage member is configured to store an aerosol-forming substrate, the atomizing assembly comprises a heating assembly and a sealing member, the sealing member is provided with a receiving groove, the heating assembly comprises a liquid absorbing member and a heating member, the liquid absorbing member is installed in the receiving groove, the liquid absorbing member comprises a liquid absorbing surface and an atomizing surface, the liquid absorbing surface is a top surface of the liquid absorbing member, the atomizing surface is a bottom surface of the liquid absorbing member, the liquid absorbing surface is configured to contact the aerosol-forming substrate, a protrusion is provided on the liquid absorbing surface, the protrusion extends upwardly from the liquid absorbing surface along an axial direction of the atomizer, the protrusion is located at the center of the liquid absorbing surface and is in the form of a hollow tube with an outer diameter smaller than an outer diameter of the liquid absorbing member, an outer circumferential surface of the protrusion is offset inwards relative to an outer circumferential surface of the liquid absorbing member such that the liquid absorbing surface is formed on the top surface of the liquid absorbing member between the outer circumferential surface of the protrusion and the outer circumferential surface of the liquid absorbing member, an air guiding passage is provided in the liquid absorbing member, the air guiding passage extends through the liquid absorbing member and the protrusion along the axial direction of the atomizer, one end of the air guiding passage passes through the atomizing surface, the other end of the air guiding passage passes through an upper end surface of the protrusion, a space defined by the receiving groove, the liquid absorbing surface and the protrusion constitutes a liquid inlet groove, the heating member is arranged on the atomizing surface, such that the aerosol-forming substrate is conducted by the liquid absorbing member from the liquid absorbing surface to the atomizing surface and atomized into smoke by the heating member arranged on the atomizing surface.

2. The atomizing assembly according to claim 1, wherein the liquid absorbing member further comprises a connecting surface, the connecting surface is the outer circumferential surface of the liquid absorbing member and is connected between the liquid absorbing surface and the atomizing surface, the liquid absorbing surface and the atomizing surface are arranged opposite to each other in the axial direction of the atomizer, a direction from the atomizing surface toward the liquid absorbing surface is defined as a first direction of the liquid absorbing member, the first direction extends along the axial direction of the atomizer, the protrusion is protrudingly provided on the liquid absorbing surface along the first direction.

3. The atomizing assembly according to claim 2, wherein a dimension of the liquid absorbing member between the atomizing surface and the liquid absorbing surface along the first direction is the height h of the liquid absorbing member, a dimension of the protrusion along the first direction is the height H of the protrusion, and $0.25 \leq H/h \leq 0.75$.

4. The atomizing assembly according to claim 2, wherein an area of any cross section of the liquid absorbing member along a direction perpendicular to the first direction is s, an area of any cross section of the protrusion along a direction perpendicular to the first direction is S, and $0.2 \leq S/s \leq 0.5$.

5. The atomizing assembly according to claim 2, wherein a dimension of the protrusion along the first direction is the height H of the protrusion, an area of any cross section of the protrusion along a direction perpendicular to the first direction is S, and $S/H \geq 10$.

6. The atomizing assembly according to claim 2, wherein a dimension of the liquid absorbing member between the atomizing surface and the liquid absorbing surface along the first direction is the height h of the liquid absorbing member, and $1.5\ \text{mm} \leq h \leq 5\ \text{mm}$.

7. The atomizing assembly according to claim 1, wherein the liquid absorbing member is made of a porous material, and the protrusion is made of a porous material.

8. The atomizing assembly according to claim 1, wherein the liquid absorbing surface and the atomizing surface are both flat and parallel to each other.

9. The atomozing assembly according to claim 1, wherein the protrusion and the liquid absorbing member are integrally formed, th eliquid absorbing member and the protrusion are made of a porous material.

10. The atomizing assembly according to claim 1, wherein the heating member is attached on the atomizing surface or embedded in the atomizing surface.

11. The atomizing assembly according to claim 1, wherein a groove side wall of the receiving groove is protrudingly provided with a resisting protrusion, an outer edge of the liquid absorbing surface abuts against the resisting protrusion, an electrode connecting end of the heating member corresponds to the resisting protrusion, the atomizing assembly further comprises a base assembly, the base assembly comprises a conductive member, the conductive member abuts against the electrode connecting end.

12. The atomizing assembly according to claim 11, wherein a direction from the atomizing surface toward the liquid absorbing surface is defined as a first direction of the liquid absorbing member, a shape of any cross section of the liquid absorbing member along a direction perpendicular to the first direction is an ellipse, two electrode connecting ends of the heating member are located at two ends of a long axis of the ellipse.

13. The atomizing assembly according to claim 11, wherein the base assembly further comprises an atomizing bracket and an atomizing seat, the atomizing bracket is connected to the atomizing seat, the beating assembly and the scaling member are sandwiched between the atomizing bracket and the atomizing seat, the conductive member is installed on the atomizing seat.

14. The atomizing assembly according to claim 13, wherein the atomizing bracket is provided with a mounting groove, the sealing member is installed in the mounting groove, the atomizing bracket is further provided with a liquid inlet hole, the liquid inlet hole is in communication with the liquid inlet groove through an open end of the sealing member next to the liquid absorbing surface.

15. The atomizing assembly according to claim 14, wherein a sealing plate is provided on the open end of the sealing member next to the liquid absorbing surface, an upper end surface of the protrusion provided on the liquid absorbing surface abuts against a lower end surface of the sealing plate, the sealing plate is provided with a communication hole, the communication hole is in communication with the liquid inlet groove and the liquid inlet hole.

16. The atomizing assembly according to claim 15, wherein the atomizing bracket is further provided with an air outlet hole, the sealing plate is further provided with an air discharge hole, the air discharge hole is in communication with the air guiding passage and the air outlet hole.

17. An atomizer comprising the atomizing assembly according to claim 1, wherein the atomizer further comprises the liquid storage member, the liquid storage member is configured to provide the aerosol-forming substrate to the atomizer.

18. An aerosol generating device comprising the atomizer according to claim 17, wherein the aerosol generating device further comprises a power supply device, and the power supply device is electrically connected to the atomizer.

* * * * *